United States Patent [19]

Guldager

[11] Patent Number: 4,802,289

[45] Date of Patent: Feb. 7, 1989

[54] INSOLE

[76] Inventor: Hans Guldager, Rypevang 4, Allerod, Denmark, 3450

[21] Appl. No.: 29,816

[22] Filed: Mar. 25, 1987

[51] Int. Cl.[4] ..... A43B 13/38

[52] U.S. Cl. ..... 36/43; 36/44; 128/594

[58] Field of Search ..... 36/43, 44, 29, 28, 3 B; 128/594, 595

[56] References Cited

U.S. PATENT DOCUMENTS

| | | | |
|---|---|---|---|
| 2,488,382 | 11/1949 | Davis | 128/594 |
| 3,765,422 | 10/1973 | Smith | 128/594 |
| 3,871,117 | 3/1975 | Richmond et al. | 36/43 |
| 4,100,686 | 7/1978 | Sgarlato | 36/29 |
| 4,123,855 | 11/1978 | Thedford | 36/44 |
| 4,446,634 | 5/1984 | Johnson et al. | 36/43 X |
| 4,458,430 | 7/1984 | Peterson | 36/29 X |
| 4,567,677 | 2/1986 | Zona | 36/43 |

FOREIGN PATENT DOCUMENTS

| | | | |
|---|---|---|---|
| 200963 | 12/1958 | Austria | 128/594 |
| 2050145 | 1/1981 | United Kingdom | 36/29 |

*Primary Examiner*—James Kee Chi

*Attorney, Agent, or Firm*—Holman & Stern

[57] ABSTRACT

In insole for promoting muscle activity has a first fluid cell confined to a toe area of the insole and a second fluid cell in the heel area. The cells are connected by at least one communicating duct which allows fluid to flow there between as a person walks on the insole. The duct has a valve system for controlling the flow as between the cells in a manner such that it may flow faster in one direction than the other.

9 Claims, 1 Drawing Sheet

INSOLE

The present invention concerns an insole to be placed in or built into footwear and of the kind that consists entirely or partially of a case filled with air or liquid and further as described in the first part of the claim.

Water-filled insoles, consisting of two layers of foil welded together along the edges and filled with water so that the entire sole makes up a water-filled case, have been known for some years. The pressure of the foot on varying places on the sole makes the water flow backwards and forwards. Typically the two layers of foil are also welded together in a few places along the midline like dot-and-dash lines, which impedes the water flow crosswide of the sole to a certain degree. Thus no attempts have been made to lead the the water flow in certain directions, and the obstacles that have been placed in the sole hamper the liquid flow equally in both directions. The sole has a certain shock-absorbing effect, and it is asserted that it massages the sole of the foot, thereby stimulating the blood circulation. As the sole is obviously made of a waterproof material and covers the entire sole of the foot, the possibilities of the skin to "breathe" are impeded. Likewise, the method of building cells filled with air, a liquid or a gel into the toe and heel partitions of hiking shoes and sports shoes with a view to shock absorption is known. The shock absorption of of such cells consists of the elasticity of the cells and the medium filled into the cells. The shock-absorbing effect will drop steeply concurrently with an increasing pressure or an increasing weight owing to the compression. If the medium could flow to other cells which were not loaded to the same degree at the same time, a more continouus absorption of pressure on the loaded cell would be achieved. However, a precondition for shock-absorption is that the flow of the medium out of the cell is hampered to a certain dgreee. The hampering effect is not very large in the above-mentioned water sole, for which reason the latter does not solve the problem in the ideal way. Further, there are numerous forms of insoles made of foam or plastic materials for shoes, where the aim is to alleviate the discomfort in connection with various types of flat feet. Generally it is characteristic of such products that they Only alleviate the discomfort without actually having a retraining effect. The objective of the present invention is to solve the above-mentioned problems in one product in a more perfect way, but also to offer other advantages which no known products offer.

Figure 1:
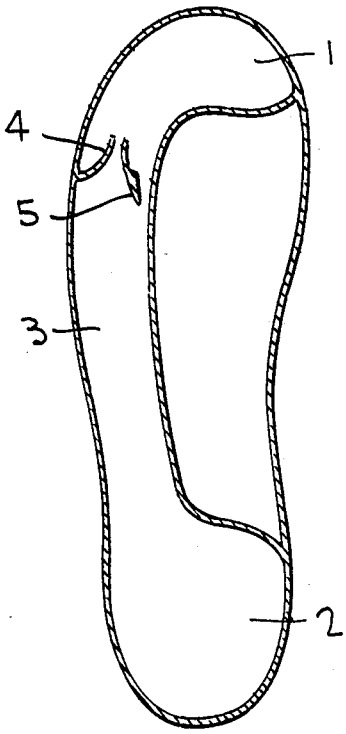

It is suggested according to the present invention that two layers of foil shall be welded together in such a way that a toe partition (1) and a heel partition (2) are created, which partitions (1) and (2) are mutually connected via one or more ducts (3, 3+ and 3″). If only one duct (3) is made, FIG. 1, a non-return valve with a large opening (4) is placed in the duct. This non-return valve permits flow between the cells (1) and (2) when it is open, while in closed condition it does not permit flow in the opposite direction through the valve (4). In FIG. 1 a version is shown which permits fast flow from heel partition (2) to toe partition (1), and where flow in the opposite direction from toe partition (1) to heel partition (2) through the valve (4) is obstructed. Most appropriate is the use of a so-called lip valve consisting of two layers of foil welded together at the sides as a non-return valve (4). Further, in this version a throttle device (5) is placed in the duct (3). The throttle device (5) may consist of a narrowing of the duct (3). Another version, FIG. 2, has two ducts, a broad duct (3′) and a narrower or confined duct (3″). In the broad duct (3′) the non-return valve (4) is placed, and in the narrower or confined duct (3″) the throttle device (5), which may be a narrowing of the duct (3″) is placed. Further, in this version a narrowing (6) may be placed in the broad duct (3′) immediately before the toe partition (1). This narrowing (6) must not confine the broad duct (3′) to such a degree that the passage through the narrowing (6) in the broad duct (3′) becomes smaller than the passage through the narrowing or throttle device (5) in the narrower duct (3′).

An insole made in accordance with the suggestion of the present invention will—when it has been placed in a shoe—function in the following way: While the person is walking the filling medium is displaced from heel partition (2), when the heel is put to the ground, and it will flow via the duct (3) and via the non-return valve (4), which in the versions shown here (FIGS. 1 and 2) permits flow through the non-return valve (4) to the toe partition (1). A non-return valve in the form of a lip valve will—even when it is open—involve a certain hampering of the flow, whereby absorption of shock to the heel is achieved. During ordinary, slow walking this absorption will be sufficient, while in the case of sports shoes a more pronounced hampering of the flow of the medium may be preferred. This can be achieved by inverting the opening direction of the non-return valve (4). Hereby the filling medium will be exposed to a stronger restraint when it is displaced from the heel partition (2), as it will have to pass the narrower duct (3″. The return flow from the toe partition (1) will in this version take place with less restraint via the broad duct (3′) when at taking-off the toes press the toe partition (1) down. Thereby a better shock absorption is obtained than in the case of the above-mentioned sports and hiking shoes or the previously mentioned water sole, which consists of one water-filled case covering the entire foot.

When a person is running or walking fast, the muscles of the toes are as a rule activated sufficiently. On the other hand, during slow walking most people develop—presumably owing to the footwear they have used throughout their lives—a way of carrying through the movement of the foot that does not apply the muscles of the toes sufficiently. Very often the feed are rotated outwards to a small or high degree (Charlie Chaplin is an extreme example), and the heels are exposed to a strong bump, the weight is dislocated over the inner arch, and taking-off is from the ball behind the big toe, perhaps over the big toe. This way of walking promotes flatfootedness, partly because the outer arch, which contributes to supporting the foot bones, is weakened owing to lack of exercise, whereby the foot bones sink down. Walking with outwards rotated feet also leads to excessive swaying of the loins, bending of the neck etc., which may result in diseases of the back, headache etc.

Figure 2:
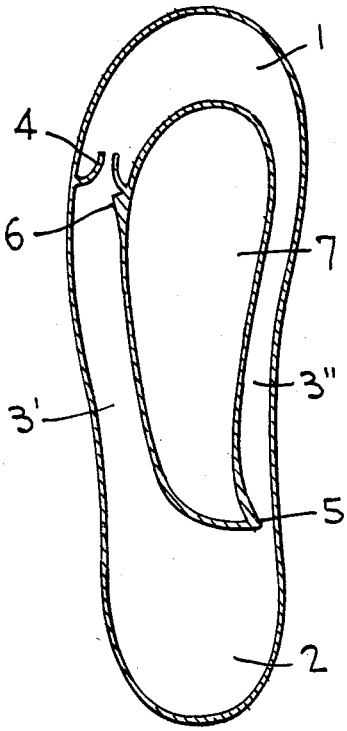
Figure 3:
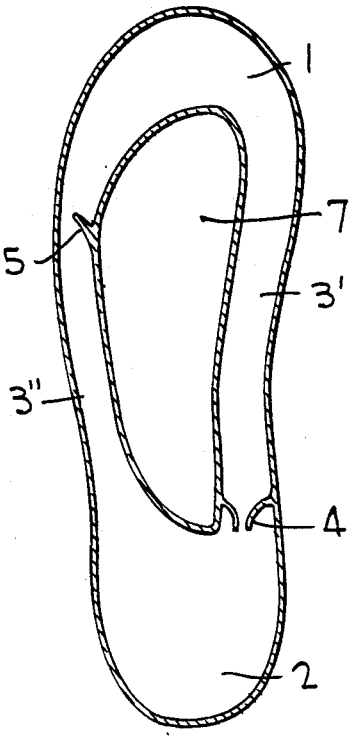

An insole according to the present invention encourages and controls the correct walk. If the sole is made as shown in FIG. 2 and placed in a shoe, it will work in the following way: During walk the filling medium will flow in the same direction as the circular movement the foot ought to perform when the movement of the foot is carried through: From the heel via the outer arch, under which the broad duct (3) is placed, to the toes. The narrowing (6) causes a stemming-up of the medium, which stimulates the outer arch, whereby the person will tend to shift part of his weight from the heel to the outer arch. The medium cannot flow back via the broad duct (3'); it must force the narrower confined duct (3''). This can only be done by the toes being pressed down and a grasing movement being made. Hereby ordinary walking becomes a training of the muscles of the toes which resembles the method recommended by therapists and physicians for training of the muscels of the toes, for cure and prevention of flatfootedness and fallen foot bones, namely the exercise that consists of picking up pencils or balls from the floor with the toes. When the toes are pressed against the floor while the movement of the foot is being carried through, walking with outwards rotated feet becomes difficult. Further, the insole made in the prescribed way ensures that this way of walking is followed, as walk where the weight is placed wrongly over the inner arch or exclusively over the ball behind the big toe will block the narrower duct (3''), whereby the medium remains under the toes, and a constant slight pressure results. This pressure is perceptible without being intolerable if the shape of the toe partition and the quantity of the medium do not lift the toes more than a few millimetres. A shoe must provide freedom og movement for the toes in the form of such a few millimetres if it is to be healthy. Thus a sole according to the present invention will also be useful when the size of shoes is to be chosen - very often a too small size is chosen.

In their everyday life, many people are forced to remain in upright position for many hours at a time. Hereby blood vessels and veins in feet and legs are strained to an extremely high degree. The heart pumps the blood out through the arteries, but the musclular-venous pump is responsible for the reflux. If the muscles of the feet are not activated while the person is in an upright position, the pressure of the liquid column on blood vessels and veins will cause varices etc. A weakening of a part of the blood circulation affects the entire circulation. The insole described in the present invention will make a standing person tilt backwards and forwards on his feet, as falling back on the heels will make the medium flow forwards to the toe partition (1), whereby the person is encouraged to press his toes downwards, and the weight is shifted forwards. When the person falls back on his heels once more, the process starts again. The dangerous constant standing on the heels, which may lead to fainting, is also precluded.

People who have a sedentary occupation will be encouraged by the described sole to rock over the foot owing to the alternating pressure against toes and heel, whereby the muscular-venous pump—and thereby the blood circulation—is kept active also in this position.

An appropriate improvement of the insole decribed in the invention will be to have the area 7 of insole that is not filled with filling medium perforated, so that the skin of the foot can "breathe".

I claim:

1. Insole for footwear and of the kind that consists at least partly of a case of a soft, flexible foil material, filled with fluid, and characterized by the fact that the interior of the case is divided into cells mutually connected by ducts, out of which one cell (1) is confined to a toe area of the sole so that in use it is under a user's toes, and one other cell (2) is placed in the heel area of the sole, and where the above-mentioned cells (1) and (2) are mutually connected via at lease two ducts (3), one of the ducts including a non-return valve (4) which permits flow of fluid through said one duct between the cells (1) and (2) in one direction and obstructs flow through said one duct in the opposite direction the other of said ducts including throttling means (5), which permits slow flow through the other of said ducts between the cells (1) and (2) in the opposite direction.

2. Insole according to claim 1, characterize d by the fact that the non-return valve (4) throttling means (5) are combined into a throttle/non-return valve.

3. Insole according to claim 1, characterized by the fact that the ducts (3) consist of one broad duct (3'), in which a non-return valve (4) is placed, and a narrower duct (3''), which duct (3'') constitutes a throttle device (5) owing to its smaller width.

4. Insole according to claim 3, characterized by the fact that the broad duct is provided with a narrowing (6) in immediate connection with the cell (1), which is placed in the toe area of the sole, the width of which narrowing (6) is larger than the width of the narrower duct (3''), and that the opening direction of the non-return valve (4) is in the same direction as circulation flow from the cell (2) in the heel area of the sole via the broad duct (3') to the cell (1) in the toe area of the sole and back via the narrower duct (3'') to the cell (2) in the heel area of the sole.

5. Insole according to claim 4, characterized by the fact that the broad duct (3') is placed in the right side of a right sole and the left side of a left sole, and that the narrower duct (3'') is placed in the left side of a right sole and the right side of a left sole.

6. Insole acording to claim 5, characterized by the fact that the area (7) enclosed by the cell (1) placed in the toe area of the sole and the cell (2) placed in the heel area of the sole and the broad duct (3') and the narrower duct (3'') is perforated.

7. Insole according to claim, characterized by the fact that the non-return valve (4) is constituted by a lip valve.

8. An insole according to claim 1 wherein the ducts extend along opposite sides of the insole and enclose therebetween a non fluid-filled portion of the insole extending from said toe area to said heel area.

9. An insole according to claim 8 wherein said one of the ducts including the non-return valve is wider than the other of said ducts including the throttling means.

* * * * *